US005595614A

United States Patent [19]

McVicker

[11] Patent Number: 5,595,614

[45] Date of Patent: Jan. 21, 1997

[54] DEEP HARDENING BORON STEEL ARTICLE HAVING IMPROVED FRACTURE TOUGHNESS AND WEAR CHARACTERISTICS

[75] Inventor: Joseph E. McVicker, Chillicothe, Ill.

[73] Assignee: Caterpillar Inc., Peoria, Ill.

[21] Appl. No.: 378,121

[22] Filed: Jan. 24, 1995

[51] Int. Cl.[6] ..... C22C 38/22; C22C 38/24

[52] U.S. Cl. ..... 148/334; 420/110; 148/328

[58] Field of Search ..... 148/334, 328; 420/110, 111

[56] References Cited

U.S. PATENT DOCUMENTS

| | | | |
|---|---|---|---|
| 2,791,500 | 5/1957 | Foley et al. | 75/124 |
| 3,044,872 | 7/1962 | Hayes | 75/126 |
| 3,165,402 | 1/1965 | Finkl | 75/128 |
| 3,254,991 | 6/1966 | Shimmin et al. | 75/128 |
| 3,366,471 | 1/1968 | Hill et al. | 75/123 |
| 3,379,582 | 4/1968 | Dickinson | 148/36 |
| 3,431,101 | 3/1969 | Kunitake et al. | 75/124 |
| 3,574,602 | 4/1971 | Gondo et al. | 75/126 |
| 3,901,690 | 8/1975 | Philip et al. | 75/123 |
| 3,944,442 | 3/1976 | Donachie | 148/12 |
| 3,973,951 | 8/1976 | Satsumabayashi | 75/126 |
| 4,052,230 | 10/1977 | Aylward | 148/2 |
| 4,129,442 | 12/1978 | Horiuchi et al. | 75/126 |
| 4,170,497 | 10/1979 | Thomas et al. | 148/36 |
| 4,765,849 | 8/1988 | Roberts | 148/335 |
| 4,790,977 | 12/1988 | Daniels et al. | 420/104 |
| 5,131,965 | 7/1992 | McVicker | 148/334 |

FOREIGN PATENT DOCUMENTS

| | | | |
|---|---|---|---|
| 1232780 | 2/1988 | Canada | 75/117 |
| 0247415 | 12/1987 | European Pat. Off. . | |
| 0306758 | 3/1989 | European Pat. Off. . | |
| 1443519 | 6/1966 | France . | |
| 897576 | 10/1953 | Germany . | |
| 54-42812 | 12/1979 | Japan . | |
| 1244360 | 9/1971 | United Kingdom . | |

OTHER PUBLICATIONS

Key To Steel, Germany, 10 Edition 1974.

*Primary Examiner*—Deborah Yee

*Attorney, Agent, or Firm*—Pankaj M. Khosla; Kenneth A. Rhoads

[57] ABSTRACT

A deep hardening boron steel has a composition comprising, by weight, about 0.23% to 0.37% carbon, about 0.40% to 1.20% manganese, about 0.50% to 2.00% silicon, about 0.25% to 2.00% chromium, about 0.20% to 0.80% molybdenum, from 0.05% to 0.25% vanadium, from 0.03% to 0.15% titanium, from 0.015% to 0.050% aluminum, from 0.0008% to 0.009% boron, and 0.005% to 0.013% nitrogen. Also, the composition preferably contains less than about 0.025% each of phosphorus and sulfur. After quenching and tempering, articles made from this material are substantially free of aluminum nitrides, have a fine martensitic grain structure, have a distribution of nanometer size background nitride, carbonitride, and carbide precipitates, and a combination of high hardness and fracture toughness.

The deep hardening steel article embodying the present invention is particularly useful for ground engaging tools that are subject breakage and wear, often at high temperature.

10 Claims, 2 Drawing Sheets

DEEP HARDENING BORON STEEL ARTICLE HAVING IMPROVED FRACTURE TOUGHNESS AND WEAR CHARACTERISTICS

TECHNICAL FIELD

This invention relates generally to a deep hardening boron steel, and more particularly to a deep hardening boron steel which, after heat treatment, has high hardness and fracture toughness.

BACKGROUND ART

Ground engaging tools, such as bucket teeth, ripper tips, track shoes, and other parts for construction machines operating in soil and rock, require a combination of high hardness throughout the tool to resist wear, high fracture toughness to avoid excessive tool breakage, and sufficient temper resistance to prevent loss of hardness during operation at elevated temperatures. A number of attempts have heretofore been made to provide a steel material having all of these characteristics.

A number of steel materials proposed for use in applications requiring a combination of desirable hardenability, toughness, and temper resistance properties, have compositions which include relatively high amounts, i.e. above 3% of chromium. For example, a steel mainly intended for use as an excavating tool edge material for construction machines is described in U.S. Pat. No. 3,973,951 issued Aug. 10, 1976 to K. Satsumabayashi et. al. This steel has a chromium content of 3.0% to 6.0%. Similarly, a wear resisting steel developed for use as a ripper tip and having 3.0% to 5.0% chromium is described in Japanese Patent 54-42812 issued Dec. 17, 1979 to applicant Kabushiki Kaisha Komatsu Seisakusho. Another steel intended for use in mining buckets and other mineral processing operations, and having a composition that preferably includes 3% to 4.5% chromium is described in U.S. Pat. No. 4,170,497 issued Oct. 9, 1979 to G. Thomas et al. The steel material embodying the present invention has high hardenability, toughness, and temper resistance, but contains no more than 2.0% chromium, and preferably between 0.35% and 1.25% chromium.

Other steels intended for use in applications requiring a combination of high hardenability and toughness require significant amounts of nickel. Examples of these compositions are disclosed in U.S. Pat. No. 2,791,500 issued May 7, 1957 to F. Foley et al, U.S. Pat. No. 3,165,402 issued Jan. 12, 1965 to W. Finkl et al, U.S. Pat. No. 3,379,582 issued Apr. 23, 1968 to H. Dickenson and, more recently, U.S. Pat. No. 4,765,849 issued Aug. 23, 1988 to W. Roberts. The steel embodying the present invention does not require the presence of nickel to achieve the desired hardenability and toughness properties.

The above mentioned U.S. Pat. No. 4,765,849 teaches the inclusion of aluminum and titanium in the steel composition, similar to that proposed by the present invention. However, U.S. Pat. No. 4,765,849 adds substantially higher amounts of aluminum (o.4% to 1.0%) than that specified in the present invention, to intentionally form aluminum nitride in the solidified product.

Contrary to the teaching of the U.S. Pat. No. 4,765,849, it is generally recognized that the presence of aluminum nitride is undesirable in steel requiring high hardenability and toughness. For example, U.S. Pat. No. 3,254,991 issued Jan. 7, 1966 to J. Shimmin, Jr. et al and U.S. Pat. No. 4,129,442 issued Dec. 12, 1978 to K. Horiuchi et al specifically exclude aluminum from the composition to prevent the formation of aluminum nitrides.

U.S. Pat. No. 5,131,965 issued Jul. 21, 1992 to J. McVicker and assigned to the same company as this instant invention, discloses a steel having high hardenability and toughness. However, U.S. Pat. No. 5,131,965 uses higher chromium to attain high hardenability and temper resistance without exploiting the hardenability and precipitation effect of boron to obtain high fracture toughness, as is done in the present invention. In addition, the present invention uses boron to lower grain boundary energy and, thus, improve fracture toughness.

The present invention is directed to overcome one or more of the problems as set forth above.

DISCLOSURE OF THE INVENTION

In one aspect of the present invention, a deep hardening boron steel article has a composition that comprises, by weight percent, from 0.23 to 0.37 carbon, from 0.4 to 1.20 manganese, from 0.50 to 2.00 silicon, from 0.25 to 2.00 chromium, from 0.20 to 0.80 molybdenum, from 0.05 to 0.25 vanadium, from 0.03 to 0.15 titanium, from 0.15 to 0.050 aluminum, from 0.0008 to 0.009 boron, less than 0.025 phosphorus, less than 0.025 sulfur, from 0.005 to 0.013 nitrogen, and the balance essentially iron. After quenching and tempering, the steel is free of any aluminum nitride.

In accordance with another aspect of the invention, a deep hardening steel article has a composition that comprises, by weight percent, from 0.23 to 0.37 carbon, from 0.4 to 1.2 manganese, from 0.50 to 2.0 silicon, from 0.25 to 2.0 chromium, from 0.2 to 0.8 molybdenum, from 0.05 to 0.25 vanadium, from 0.03 to 0.15 titanium, from 0.015 to 0.05 aluminum, from 0.0008 to 0.009 boron, less than 0.025 phosphorus, less than 0.025 sulfur, from 0.005 to 0.013 nitrogen, and the balance essentially iron, said steel having, after quenching and tempering, a hardness of at least $R_c$ 45 measured at the middle of a section having a thickness of no more than 25.4 mm (1 in).

In accordance with yet another aspect of the invention, a deep hardening steel article having a composition comprising, by weight percent, from 0.23 to 0.37 carbon, from 0.4 to 1.2 manganese, from 0.50 to 2.0 silicon, from 0.25 to 2.0 chromium, from 0.2 to 0.8 molybdenum, from 0.05 to 0.25 vanadium, from 0.03 to 0.15 titanium, from 0.015 to 0.05 aluminum, 0.0008 to 0.009 boron, less than 0.025 phosphorus, less than 0.025 sulfur, from 0.005 to 0.013 nitrogen, and the balance essentially iron, said steel having, after quenching and tempering, a hardness of at least $R_c$ 45 measured at 12.7 mm (0.5 in) below the surface of a section having a thickness greater than 25.4 mm (1 in).

BEST MODE FOR CARRYING OUT THE INVENTION

Figure 1:
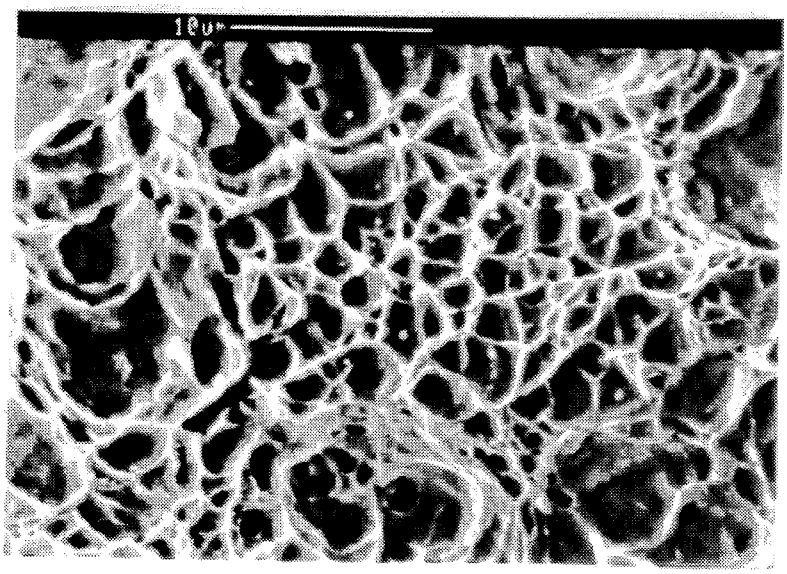
FIG. 1 is a scanning electron microscope (SEM) photograph of a typical fracture surface of a deep hardening steel according to the present invention.

In the preferred embodiment of the present invention, a deep hardening steel has a composition comprising, by weight percent:

| | |
|---|---|
| carbon | 0.23 to 0.37 |
| manganese | 0.40 to 1.20 |
| silicon | 0.50 to 2.00 |
| chromium | 0.25 to 2.00 |
| molybdenum | 0.20 to 0.80 |
| vanadium | 0.05 to 0.25 |
| titanium | 0.03 to 0.15 |
| aluminum | 0.015 to 0.050 |
| phosphorus | less than 0.025 |
| sulfur | less than 0.025 |
| boron | 0.0008 to 0.009 |
| nitrogen | 0.005 to 0.013 |
| balance | essentially balance |

The deep hardening steel of the present invention is essentially free of nickel and copper. However it should be understood that the above described steel composition may contain small quantities of nickel and copper which are not required and are considered incidental. In particular, up to 0.25% nickel and up to 0.35% copper may be present as residual elements in accepted commercial practice.

The term "deep hardening steel" as used herein means a steel having properties that permit a component made thereof to be hardened throughout its cross-section or as nearly throughout as possible.

The term "quenching and tempering" as used herein means a heat treatment which achieves a fully quenched microstructure. For the steel material described in the illustrative Examples A–F described below, the heat treatment specifically includes the following steps:

1. Through heating the test sample to the austenitizing temperature of the steel to produce a homogeneous solution throughout the section without harmful decarburization, grain growth, or excessive distortion. In the following illustrative Examples A and B, the articles were heated to 870° C. (1598° F.) for about one hour. In the following illustrative Examples C, D, E, and F, the articles were heated to about 950° C. (1742° F.) for about one hour.
2. Fully quenched in water to produce the greatest possible depth of hardness.
3. Tempered by reheating for a sufficient length of time to permit temperature equalization of all sections. In the illustrative Examples described below, the articles were reheated to about 215° C. (420° F.) for about one hour.

The higher molybdenum contents in the following illustrative Examples C, D, E, and F require a higher austenitizing temperature to assure molybdenum carbides are taken into solution prior to quenching.

The fracture toughness of all the Examples described below was measured according to ASTM test method E 1304, standard test method for plane-strain (Chevron-Notch) fracture toughness of metallic materials. The specimens for the fracture toughness measurements were all cut from a larger test sample so as to have an L-T orientation with respect to the direction of rolling of the sample source material, as defined by ASTM test method E 399, test method for plane-train toughness of metallic materials.

The steel material embodying the present invention is essentially free of aluminum nitrides and has, after quenching and tempering, has a fine martensitic microstructure and a distribution of nanometer size nitride, carbonitride, and carbide precipitates.

Further, as shown by the following Examples, the steel material embodying the present invention has improved fracture toughness properties and substantially the same, or better, hardenability when compared with similar prior art steel materials.

EXAMPLE A

An experimental ingot representative of the low end of composition typical of that used by the assignee of the present invention for track shoe and other undercarriage applications, was melted, poured, and rolled to about 7:1 reduction to form a 43 mm (1.7 in) square bar. After rolling, the bar was found, by spectrographic methods, to have the following composition:

| | |
|---|---|
| carbon | 0.22 |
| manganese | 1.08 |
| silicon | 0.23 |
| chromium | 0.51 |
| molybdenum | 0.06 |
| aluminum | 0.036 |
| phosphorus | 0.017 |
| sulfur | 0.005 |
| titanium | 0.042 |
| boron | 0.001 |
| nitrogen | 0.011 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM test method E1304 and found to have the following properties:

| | | |
|---|---|---|
| Hardness $R_C$ | 48 | |
| Fracture Toughness $K^{IV}$ | 122 | MPa $\sqrt{m}$ (111 ksi/$\sqrt{in}$) |

Hardness measurements were made on each of the test specimens at a point about 12.7 mm (0.5 in) below the grip slot face end of the short rod specimens. The fracture toughness value is the average value of the three short rod specimens tested.

EXAMPLE B

An experimental ingot representative of the high end of composition typical of that used by the assignee of the present invention for track shoe and other undercarriage applications, was melted, poured, and rolled to about 7:1 reduction to form a 43 mm (1.7 in) square bar. After rolling, the bar was found, by spectrographic methods, to have the following composition:

| | |
|---|---|
| carbon | 0.28 |
| manganese | 1.28 |
| silicon | 0.24 |
| chromium | 0.61 |
| molybdenum | 0.11 |
| aluminum | 0.036 |
| phosphorus | 0.019 |
| sulfur | 0.005 |

-continued

| | |
|---|---|
| titanium | 0.043 |
| boron | 0.001 |
| nitrogen | 0.011 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM E1304 and found to have the following properties:

| | | |
|---|---|---|
| Hardness $R_C$ | 51 | |
| Fracture Toughness $K^{IV}$ | 100 | MPa $\sqrt{m}$ (91 ksi/$\sqrt{in}$) |

Hardness measurements were made on each of the test specimens at a point about 12.7 mm (0.5 in) below the grip slot face end of the short rod specimens. The fracture toughness value is the average value of the three short rod specimens tested.

EXAMPLE C

An experimental ingot, representative of the deep hardening steel embodying the present invention, was melted, poured, and rolled to about 7:1 reduction to form a 43 mm (1.7 in) square bar.

Importantly, in the preparation of this melt, the titanium addition was made in the ladle concurrently with the addition of aluminum. It has been discovered that the addition of titanium must be made concurrently with, or later than, the aluminum addition. Titanium has a stronger affinity for nitrogen than either aluminum or boron and has a dual purpose. First, to protect boron from nitrogen to provide effective boron for hardenability enhancement and second, to protect aluminum from nitrogen and, thus, preclude the possibility of forming undesirable aluminum nitride which has a negative effect on fracture toughness. The early, or concurrent, addition of aluminum is necessary to protect the titanium from oxygen. Aluminum is a thermodynamically stronger oxide former than titanium at liquid steel temperatures. Thus, in the present invention, the formation of undesirable aluminum nitride is prevented.

The presence of nitride, carbonitride, and/or carbide forming elements silicon, molybdenum, vanadium, titanium, and boron, in the presence of nitrogen and carbon, provides the opportunity to form nanometer size precipitates upon quenching. It is believed that the significantly higher fracture toughness observed for the steel that represents the present invention is the result of freedom from aluminum nitrides and a distribution of nanometer size nitride, carbonitride and carbide precipitates.

The steel from this ingot was spectrographically analyzed and had the following composition:

| | |
|---|---|
| carbon | 0.26 |
| manganese | 0.55 |
| silicon | 1.56 |
| chromium | 0.34 |
| molybdenum | 0.15 |

-continued

| | |
|---|---|
| aluminum | 0.032 |
| phosphorus | 0.015 |
| sulfur | 0.007 |
| titanium | 0.042 |
| vanadium | 0.10 |
| boron | 0.002 |
| nitrogen | 0.011 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM E1304 and found to have the following properties:

| | | |
|---|---|---|
| Hardness $R_C$ | 48 | |
| Fracture Toughness $K^{IV}$ | 155 | MPa $\sqrt{m}$ (141 ksi/$\sqrt{in}$) |

Hardness measurements were made on each of the test specimens at a point about 12.7 mm (0.5 in) below the grip slot face end of the short rod specimens. The fracture toughness value is the average value of the three Short rod specimens tested.

Fracture surfaces from the fracture surfaces of short rod fracture toughness specimens were examined by scanning electron microscope (SEM) techniques. No aluminum nitrides were observed in any specimen. The fracture surfaces all showed predominantly very fine ductile dimples which is consistent with microvoid nucleation and growth that occurs in materials having a very fine distribution of coherent background particles.

EXAMPLE D

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.26 |
| manganese | 0.56 |
| silicon | 1.59 |
| chromium | 0.34 |
| molybdenum | 0.21 |
| aluminum | 0.032 |
| phosphorus | 0.015 |
| sulfur | 0.007 |
| titanium | 0.044 |
| vanadium | 0.10 |
| boron | 0.002 |
| nitrogen | 0.01 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM E1304 and found to have the following properties:

| | | |
|---|---|---|
| Hardness $R_C$ | 48 | |
| Fracture Toughness $K^{IV}$ | 158 | MPa $\sqrt{m}$ (144 ksi/$\sqrt{in}$) |

Hardness measurements were made on each of the test specimens at a point about 12.7 mm (0.5 in) below the grip slot face end of the short rod specimens. The fracture toughness value is the average value of the three short rod specimens tested.

Fracture surfaces from the fracture surfaces of short rod fracture toughness specimens were examined by SEM techniques. No aluminum nitrides were observed in any specimen. The fracture surfaces all showed predominantly very fine ductile dimples which is consistent with microvoid nucleation and growth that occurs in materials having a very fine distribution of coherent background particles.

EXAMPLE E

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.27 |
| manganese | 0.55 |
| silicon | 1.56 |
| chromium | 0.35 |
| molybdenum | 0.35 |
| aluminum | 0.033 |
| phosphorus | 0.015 |
| sulfur | 0.007 |
| titanium | 0.043 |
| vanadium | 0.10 |
| boron | 0.002 |
| nitrogen | 0.011 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM E1304 and found to have the following properties:

| | | |
|---|---|---|
| Hardness $R_C$ | 50 | |
| Fracture Toughness $K^{IV}$ | 151 | MPa $\sqrt{m}$ (137 ksi/$\sqrt{in}$) |

Hardness measurements were made on each of the test specimens at a point about 12.7 mm (0.5 in) below the grip slot face end of the short rod specimens. The fracture toughness value is the average value of the three short rod specimens tested.

Fracture surfaces from the fracture surfaces of short rod fracture toughness specimens were examined by SEM (scanning electron microscope) techniques. No aluminum nitrides were observed in any specimen. The fracture surfaces all showed predominantly very fine ductile dimples which is consistent with microvoid nucleation and growth that occurs in materials having a very fine distribution of coherent background particles.

EXAMPLE F

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.26 |
| manganese | 0.55 |
| silicon | 1.55 |
| chromium | 0.34 |
| molybdenum | 0.38 |
| aluminum | 0.03 |
| phosphorus | 0.014 |
| sulfur | 0.007 |
| titanium | 0.041 |
| vanadium | 0.10 |
| boron | 0.002 |
| nitrogen | 0.01 |
| iron | essentially balance |

After rolling, three 25.4 mm (1 in) diameter short rod fracture toughness test specimens were machined from bar in accordance with ASTM test method E1304 having L-T orientation as described in ASTM test method E399. The fracture toughness test specimens were heat treated according to the above defined quench and temper operation to obtain a fully martensitic microstructure, tested in accordance with ASTM E1304 and found to have the following properties:

| | | |
|---|---|---|
| Hardness $R_C$ | 50 | |
| Fracture Toughness $K^{IV}$ | 159 | MPa $\sqrt{m}$ (145 ksi/$\sqrt{in}$) |

Hardness measurements were made on each of the test specimens at a point about 12.7 mm (0.5 in) below the grip slot face end of the short rod specimens. The fracture toughness value is the average value of the three short rod specimens tested.

Surfaces from the fracture faces of short rod fracture toughness specimens were examined by SCM techniques. No aluminum nitrides were observed in any specimen. The fracture surfaces all showed predominantly very fine ductile dimples which is consistent with microvoid nucleation and growth that occurs in materials having a very fine distribution of coherent background particles.

Figure 2:
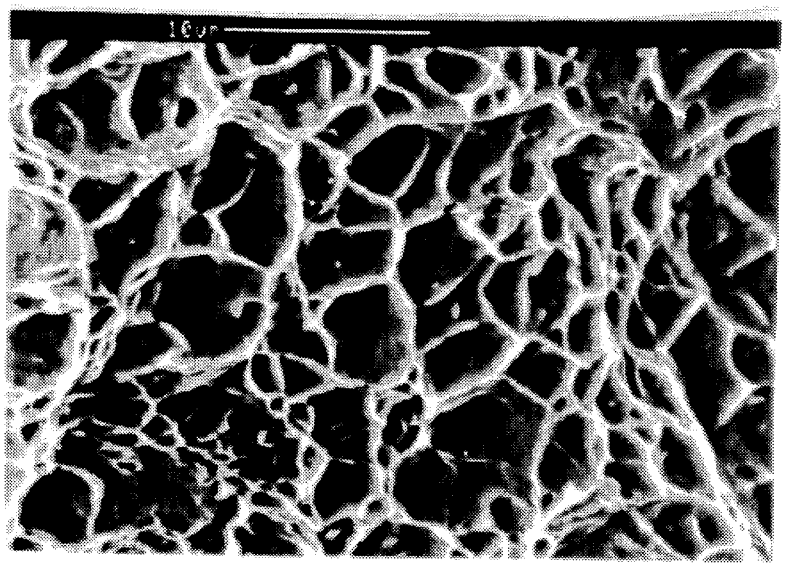
Fig. 2 (PRIOR ART)
FIG. 2 is a SEM photograph of a typical fracture surface of a prior art deep hardening steel.

FIG. 1 shows the fracture surface of the deep hardening steel embodying the present invention. The fracture surface is primarily fine ductile dimples which is consistent with the observed high fracture toughness. FIG. 2 shows a fracture surface of a prior art steel. As shown in FIG. 1, the ductile dimples of the deep hardening steel embodying the present invention are finer than that of the prior art deep hardening steel shown in FIG. 2. For example, a significant number of the ductile dimples shown in FIG. 1, have a spacing of 1–2 microns while the majority of the dimples in the prior art steel shown in FIG. 2 have a spacing of approximately 5 microns.

Figure 3:
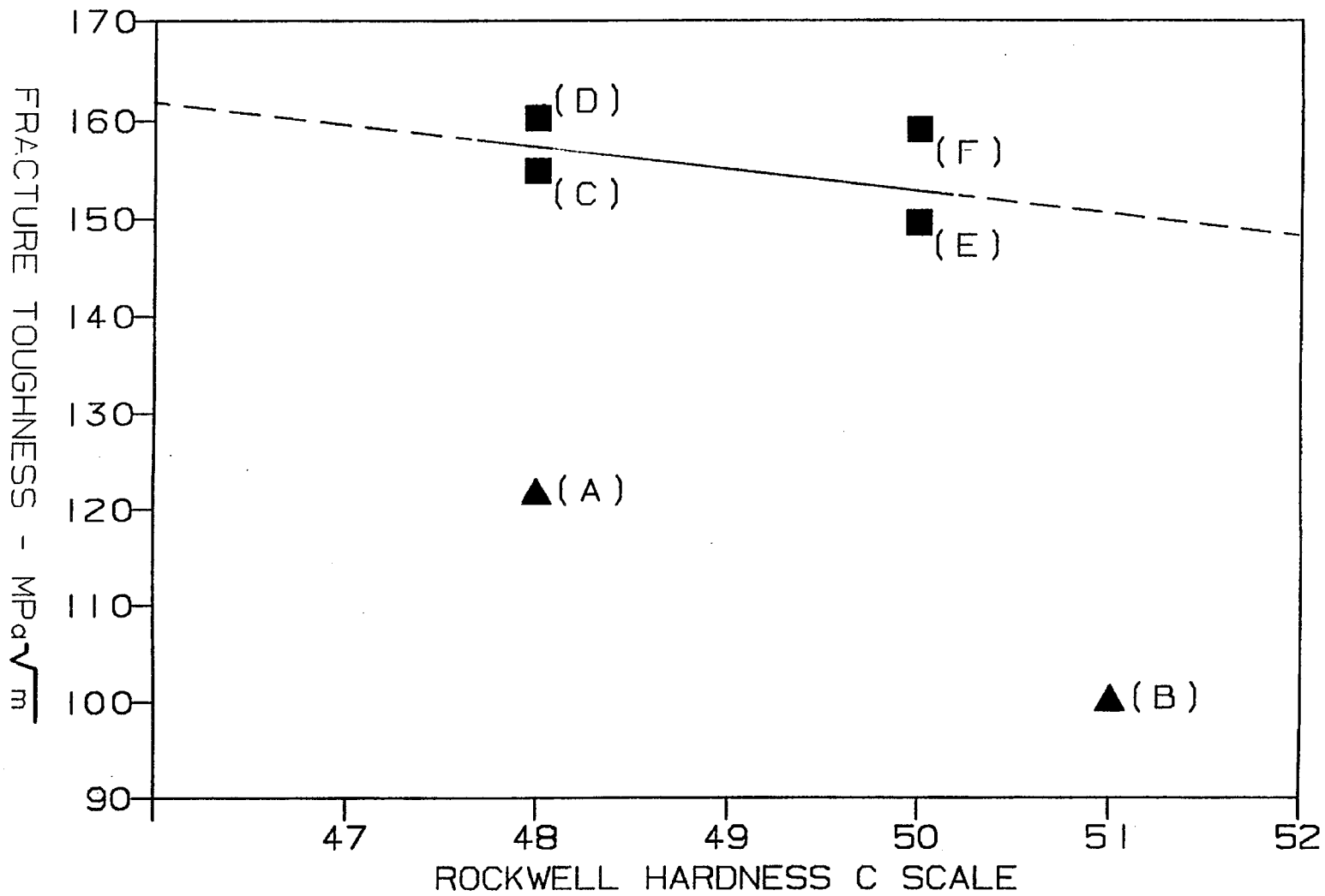
FIG. 3 is a graph showing the relationship between hardness and fracture toughness for the prior art steel and the steel embodying the present invention.

The respective hardness and fracture toughness values of the prior art deep hardening steel described in Examples A and B, and the deep hardening steel embodying the present invention described in Examples C, D, E, and F, are graphically shown in FIG. 3. The improvement in fracture toughness over the prior art material, in similar hardness ranges, is very apparent.

To assure sufficient hardenability and yet not adversely affect toughness properties, carbon should be present, in the composition of the steel embodying the present invention, in a range of from about 0.23% to about 0.37%, by weight, and preferably from about 0.23% to 0.31%, by weight.

The subject deep hardening steel also requires manganese in an amount of at least 0.40% by weight, and no more than 1.20%, by weight to prevent formation of iron sulfides and enhance hardenability.

Chromium should be present in the subject steel composition in an amount of at least 0.25% by weight and no more than 2.00% to provide sufficient temper resistance and hardenability.

The subject steel should contain silicon in an amount of at least 0.50% by weight and no more than 2.00% by weight to provide. temper resistance and hardenability.

Molybdenum should also be present in the subject steel composition in an amount of at least 0.20% by weight to further assure temper resistance and hardenability, as well as, contribute to small background precipitates. No more than 0.80% by weight is needed to assure that the values of these properties will be beneficially high.

It is also desirable that a small amount of vanadium be included in the composition of the subject steel composition to further promote temper resistance, secondary hardening, and background precipitates in combination with molybdenum. For this purpose, vanadium should be present in amounts of at least 0.05%, and preferably about 0.12%, by weight. The beneficial contribution of vanadium is accomplished with the presence of no more than 0.25%, preferably about 0.12%, by weight, in the steel.

Boron may be present in amount of at least 0.0008%, preferably about 0.002%, by weight, to enhance hardenability, contribute to background precipitates, and reduce grain boundary energy.

The steel composition embodying the present invention must have small, but essential, amounts of both aluminum and titanium. Furthermore, as described above in Example C, it is imperative that the addition of titanium be made to the melt concurrent with, or after, the addition of aluminum to prevent the formation of undesirable aluminum nitrides. At least about 0.015% aluminum and about 0.03% titanium is required to provide beneficial amounts of these elements. Titanium nitrides and carbonitrides contribute to the beneficial background precipitates. To assure the desirable interactions of these elements with oxygen, and particularly with nitrogen, aluminum should be limited to no more than 0.05%, and preferably about 0.025%, by weight, and titanium should be limited to no more than 0.15%, preferably about 0.05%, by weight.

To assure that there is sufficient nitrogen to combine with titanium and vanadium to form titanium and vanadium nitrides and carbonitrides, it is extremely important that at least 0.005% nitrogen, by weight, is present in the steel composition. Preferably the nitrogen content is between about 0.008% and 0.013%, by weight. Also, it is desirable that normal electric furnace steelmaking levels of oxygen, i.e., about 0.002% to 0.003%, by weight, be attained.

It is also desirable that the steel embodying the present invention contain no more than 0.025%, by weight, phosphorus and sulfur to assure that these elements do not adversely affect the toughness properties of the material. Preferably, the composition contains no more than 0.010%, by weight, sulfur and no more than 0.015%, by weight, phosphorus.

In summary, the above examples demonstrate that a significant increase in fracture toughness of deep hardening steel can be achieved by the controlled addition of relatively small, but essential, amounts of aluminum and titanium. The mechanism by which the relatively small amounts of these elements beneficially cooperate to refine the microstructure and improve toughness, without a decrease in hardness is described in Example C. The deep hardening steel composition embodying the present invention is essentially free of any detrimental aluminum nitrides.

Industrial Applicability

The deep hardening steel of the present invention is particularly useful in applications requiring tools that are subject to severe wear, or abrasion, and are also subject to breakage. Examples of such tools include ground engaging implements used in construction, such as bucket teeth, ripper tips, and track shoes.

Further, the deep hardening steel described herein is economical to produce and does not require relatively high amounts, i.e., more than 2% chromium nor the inclusion of nickel or cobalt in the composition. Further, the deep hardening steel embodying the present invention responds to conventional quenching and tempering operations. Articles formed of this material do not require specialized equipment or heat treatment to provide high hardness, fracture toughness, and temper resistance in the treated article.

Other aspects, objectives, and advantages of this invention can be obtained from a study of the drawings, the disclosure and the appended claims.

I claim:

1. A deep hardening steel article having a composition comprising, by weight percent, from 0.23 to 0.37 carbon, from 0.4 to 1.2 manganese, from 0.5 to 2.0 silicon, from 0.25 to 2.0 chromium, from 0.2 to 0.8 molybdenum, from 0.05 to 0.25 vanadium, from 0.03 to 0.15 titanium. from 0.015 to 0.05 aluminum, from 0.0008 to 0.009 boron, less than 0.025 phosphorus, less than 0.025 sulfur, from 0.005 to about 0.013 nitrogen, and the balance essentially iron, said steel article being free of any detrimental aluminum nitride and having been quenched and tempered to produce a fine martensitic microstructure and a distribution of nanometer size background nitride, carbonitride, and carbide precipitates, said precipitates being spaced apart no greater than about 0.003 mm.

2. A deep hardening steel article, as set forth in claim 1, wherein said composition comprises, by weight percent, 0.23 to 0.32 carbon, 0.4 to 1.0 manganese, 0.75 to 1.6 silicon, 0.25 to 1.5 chromium, 0.2 to 0.6 molybdenum, 0.05 to 0.12 vanadium, 0.03 to 0.07 titanium, 0.015 to 0.05 aluminum, less than 0.015 phosphorus, less than 0.01 sulfur, 0.0008 to 0.005 boron, 0.008 to 0.013 nitrogen, and the balance essentially iron.

3. A deep hardening steel article, as set forth in claim 2, wherein said steel article after having been quenched and tempered has a hardness of at least $R_c$ 45 at the middle of a section having a thickness of no more than 25.4 mm (1 in), and a plane strain fracture toughness of at least 140 MPa (127 ksi).

4. A deep hardening steel article, as set forth in claim 2, wherein said steel article after having been quenched and tempered, has a hardness of at least $R_c$ 45 measured at 12.7 mm (0.5 in) below a surface of a section having a thickness greater than 25.4 mm (1 in), and a plane strain fracture toughness of at least 140 MPa (127 ksi).

5. A deep hardening steel article having a composition comprising, by weight percent, from 0.23 to 0.37 carbon, from 0.4 to 1.2 manganese, from 0.50 to 2.0 silicon, from 0.25 to 2.0 chromium, from 0.2 to 0.8 molybdenum, from 0.05 to 0.25 vanadium, from 0.03 to 0.15 titanium, from 0.015 to 0.05 aluminum, from 0.0008 to 0.009 boron, less than 0.025 phosphorus, less than 0.025 sulfur, from 0.005 to 0.013 nitrogen, and the balance essentially iron, said steel having been quenched and tempered to produce a hardness of at least $R_c$ 45 measured at the middle of a section having a thickness of no more than 25.4 mm (1 in), and a plane strain fracture toughness of at least 140 MPa (127 ksi).

6. A deep hardening steel article, as set forth in claim 5, wherein said steel article is free of any detrimental aluminum nitride and, after having been quenched and tempered has a fine martensitic microstructure and a distribution of nanometer size background nitride, carbonitride, and carbide precipitates.

7. A deep hardening steel article, as set forth in claim 5, wherein said composition comprises, by weight percent, 0.23 to 0.32 carbon, 0.4 to 1.0 manganese, 0.75 to 1.6 silicon, 0.25 to 1.5 chromium, 0.2 to 0.6 molybdenum, 0.05 to 0.12 vanadium, 0.03 to 0.07 titanium, 0.015 to 0.05 aluminum, less than 0.015 phosphorus, less than 0.01 sulfur, 0.0008 to 0.005 boron, 0.008 to 0.013 nitrogen, and the balance essentially iron.

8. A deep hardening steel article having a composition comprising, by weight percent, from 0.23 to 0.37 carbon, from 0.4 to 1.2 manganese, from 0.50 to 2.0 silicon, from 0.25 to 2.0 chromium, from 0.2 to 0.8 molybdenum, from 0.05 to 0.25 vanadium, from 0.03 to 0.15 titanium, from 0.015 to 0.05 aluminum, 0.0008 to 0.009 boron, less than 0.025 phosphorus, less than 0.025 sulfur, from 0.005 to 0.013 nitrogen, and the balance essentially iron, said steel having been quenched and tempered to produce a hardness of at least $R_c$ 45 measured at 12.7 mm (0.5 in) below the surface of a section having a thickness greater than 25.4 mm (1 in), and a plane strain fracture toughness of at least 140 MPa (127 ksi), and a fine martensitic microstructure, and a distribution of nanometer size background nitride, carbonitride, and carbide precipitates, said precipitates being spaced apart no greater than about 0.003 mm.

9. A deep hardening steel article, as set forth in claim 8, wherein said steel article is free of any detrimental aluminum nitride and, after having been quenched and tempered has a fine martensitic microstructure and a distribution of nanometer size background nitride, carbonitride, and carbide precipitates.

10. A deep hardening steel article, as set forth in claim 8, wherein said composition comprises, by weight percent, 0.23 to 0.32 carbon, 0.4 to 1.0 manganese, 0.75 to 1.6 silicon, 0.25 to 1.5 chromium, 0.2 to 0.6 molybdenum, 0.05 to 0.12 vanadium, 0.03 to 0.07 titanium, 0.015 to 0.05 aluminum, less than 0.015 phosphorus, less than 0.01 sulfur, 0.0008 to 0.005 boron, 0.008 to 0.013 nitrogen, and the balance essentially iron.

* * * * *